US005987664A

United States Patent [19]

Somerton et al.

[11] Patent Number: 5,987,664

[45] Date of Patent: Nov. 23, 1999

[54] INVALID HOISTS

[75] Inventors: Bruce Edward Somerton, Norton; John Greaves, Romsey, both of United Kingdom

[73] Assignee: Arjo Limited, Gloucestershire, United Kingdom

[21] Appl. No.: 09/131,366

[22] Filed: Aug. 7, 1998

[30] Foreign Application Priority Data

Aug. 8, 1997 [GB] United Kingdom ..... 9716705

[51] Int. Cl.[6] ..... A61G 7/10

[52] U.S. Cl. ..... 5/86.1; 5/83.1; 5/87.1

[58] Field of Search ..... 5/81.1 R, 83.1, 5/86.1, 87.1, 89.1

[56] References Cited

U.S. PATENT DOCUMENTS

| | | | |
|---|---|---|---|
| 3,407,413 | 10/1968 | James | 5/87.1 |
| 3,694,829 | 10/1972 | Bakker | 5/87.1 |
| 4,409,696 | 10/1983 | Bakker | 5/87.1 |
| 4,712,257 | 12/1987 | James | 5/83.1 |
| 4,742,588 | 5/1988 | James | 5/83.1 |
| 5,649,329 | 7/1997 | Horcher et al. | 5/83.1 |
| 5,692,253 | 12/1997 | Keijser et al. | 5/87.1 X |
| 5,784,729 | 7/1998 | Dunn et al. | 5/86.1 |
| 5,845,348 | 12/1998 | Dunn et al. | 5/86.1 X |

*Primary Examiner*—Michael F. Trettel
*Assistant Examiner*—Robert G. Santos
*Attorney, Agent, or Firm*—Young & Thompson

[57] ABSTRACT

The invalid hoist comprises a lifting arm, a sling hanger support angularly displaceable relative to the lifting arm about a vertical or substantially vertical axis, and a sling hanger which is a unitary construction pivotable about a horizontal axis relative to the sling hanger support and which presents two spaced sling attachment points on one side of the horizontal axis and at least one sling attachment point on the other side of the horizontal axis. The invalid hoist also comprises rotary drive means for pivoting the sling hanger about said horizontal axis relative to the sling hanger support and switch means for selectively rotating the rotary drive means in one or other of two opposite directions.

9 Claims, 3 Drawing Sheets

INVALID HOISTS

This invention relates to invalid hoists for use with slings in which invalids are suspended during lifting.

It is known form GB-A-2184706 to provide an invalid hoist with a lifting arm, a sling hanger support which is supported for angular displacement relative to a lifting arm of the hoist about a vertical axis, a sling hanger which is pivotable about a horizontal axis relative to the sling hanger support and which presents spaced sling attachment points on both sides of the horizontal axis, and means for retaining the hanger in alternative angular positions about said horizontal axis. The preferred retaining means, and indeed that used in practice, has been frictional means allowing the hanger to be infinitely adjustable in position throughout an operative range of angular movement. The drawback of this arrangement is that the frictional restraint to movement about said horizontal axis imposes a strain on an attendant, particularly on the wrists of the attendant, and especially when an operating handle of the hanger is in a raised position.

The present invention seeks to provide an invalid hoist which overcomes this drawback.

SUMMARY OF THE INVENTION

According to the present invention, there is provided an invalid hoist comprising a lifting arm, a sling hanger support angularly displaceable relative to the lifting arm about a vertical or substantially vertical axis, a sling hanger which is a unitary construction pivotable about a horizontal axis relative to the sling hanger support and which presents two spaced sling attachment points on one side of the horizontal axis and at least one sling attachment point on the other side of the horizontal axis for connection of a first pair of sling attachments to one side of the horizontal axis and for connection of a second pair of sling attachments to the opposite side of the horizontal axis, rotary drive means for pivoting the sling hanger about said horizontal axis relative to the sling hanger support, and switch means for selectively rotating the rotary drive means in one or other of two opposite directions.

Preferably, the rotary drive means comprises an electric motor and gear box unit and a rotary actuator rotatable by the motor and gear box unit.

Preferably, the sling hanger is provided at one end with a hand grip which is pivotable to a limited extent in a vertical or substantially vertical plane relative to the sling hanger, the switch means being operable by pivotable movement of the hand grip in an upwards direction to cause the rotary drive means to pivot the sling hanger so that said one end of the sling hanger is raised relative to the other end and the switch means being operable by pivotable movement of the hand grip in a downwards direction to cause the rotary drive means to pivot the sling hanger so that said one end of the sling hanger is lowered relative to the other end.

Preferably, the sling hanger support is of inverted generally U-shaped configuration and the sling hanger comprises a generally U-shaped part, the two limbs of which are pivotally connected to the lower ends of the two limbs of the sling hanger support, respectively, and a central arm extending from the base of the generally U-shaped part away from the pivot axis between the sling hanger and sling hanger support. In this case, preferably, each limb of the U-shaped part has a sling attachment at or adjacent to its free end and at least one sling attachment is provided on the central arm. The hand grip is, preferably, provided at the free end of the central arm.

The invention will now be more particularly described, by way of example, with reference to the accompanying drawings.

DESCRIPTION OF THE PREFERRED EMBODIMENT

Figure 1:
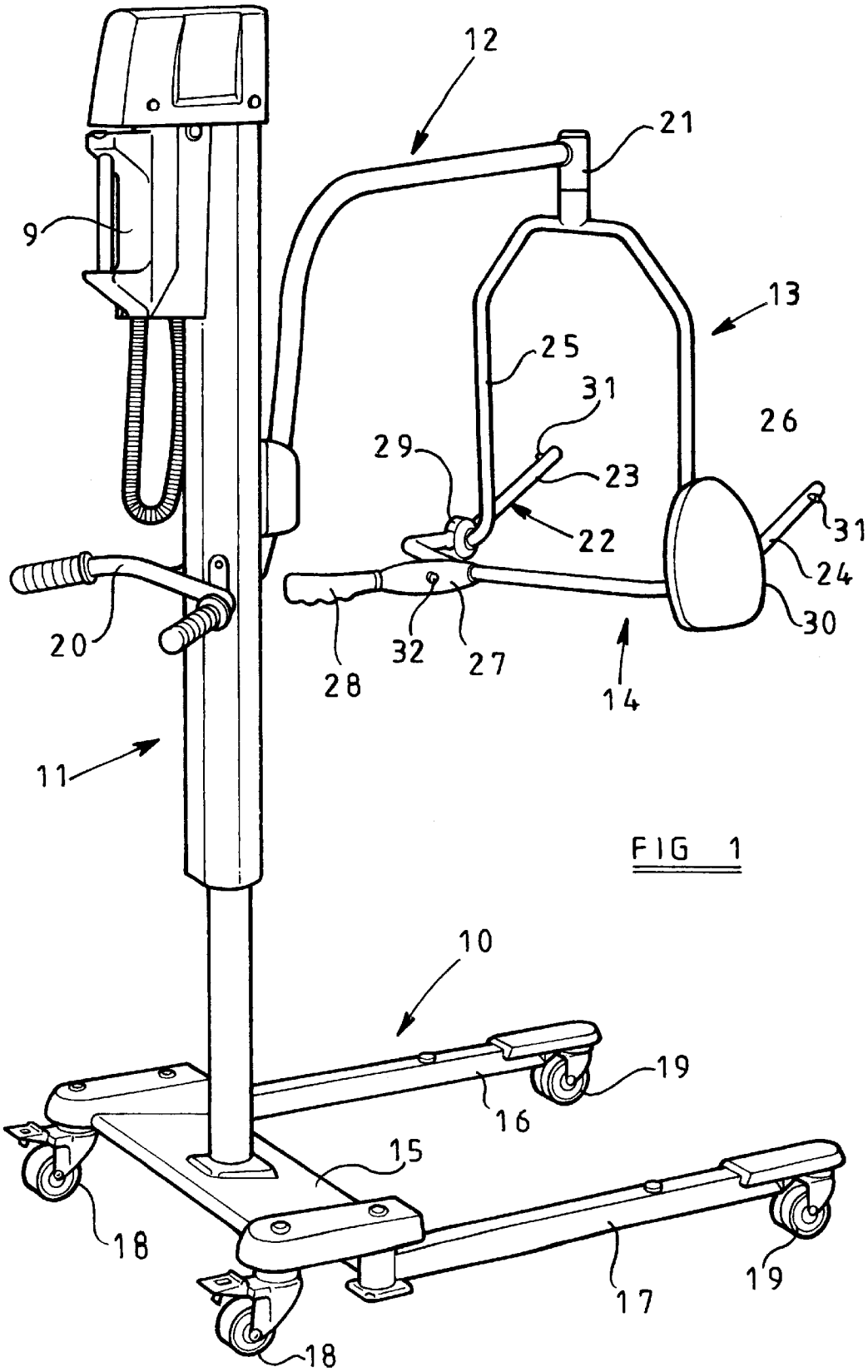
FIG. 1 is a perspective view of one embodiment of a lifting hoist according to the present invention.

Referring firstly to FIG. 1 of the drawings, the invalid hoist shown therein comprises a chassis 10, a lifting column 11 upstanding from the chassis 10, a lifting arm 12 projecting from the lifting column 11, a sling hanger support 13 at the free or outer end of the lifting arm 12 and a sling hanger 14 supported by the sling hanger support 13.

The chassis 10, lifting column 11 and lifting arm 12 are now well known.

The chassis comprises a transversely extending part 15 from which the lifting column 11 upstands and two arms 16 and 17 pivotable relative to the part 15 between positions in which they extend parallel to one another and positions in which they are splayed apart at their outer free ends. The part 15 has two castors 18 and a further castor 19 is provided at the free end of each of the arms 16 and 17.

The lifting column 11 includes a motor driven actuator (not shown) such as is described in EP-A-0424344, for raising and lowering the lifting arm 12 relative to the lifting column 11. A rechargeable battery 9 is mounted on the lifting column 11 and powers the motor driven actuator.

A handle 20 is provided on the lifting column 11 whereby an attendant can move the invalid hoist along the floor.

The sling hanger support 13 is in the form of an inverted, generally U-shaped, member which is mounted in a vertical bearing 21 at the free outer end of the lifting arm 12 to turn about a rigid vertical axis.

The sling hanger 14 has a generally U-shaped part 22 having two limbs 23 and 24 which are pivotally connected to the lower ends of the limbs 25 and 26, respectively, of the sling hanger support 13 for pivotable movement about a common horizontal axis and a central arm 27 extending from the base of the U-shaped part 22 away from said horizontal axis. A hang grip 28 is provided at the free end of the arm 27.

A simple pivotable connection 29 is provided between the lower end of the limb 25 of the sling hanger support 13 and the limb 23 of the sling hanger 14. However, a rotary drive mechanism 30 is provided between the lower end of the limb 26 of the sling hanger support 13 and the limb 24 of the sling hanger 14.

Sling attachments 31, in the form of headed studs, are provided at or adjacent to the free ends of the limbs 23 and 24 and two further sling attachments, also in the form of headed studs 32, are provided on opposite sides of the arm 27. The studs 32 could, however, be replaced by a single stud.

Figure 2:
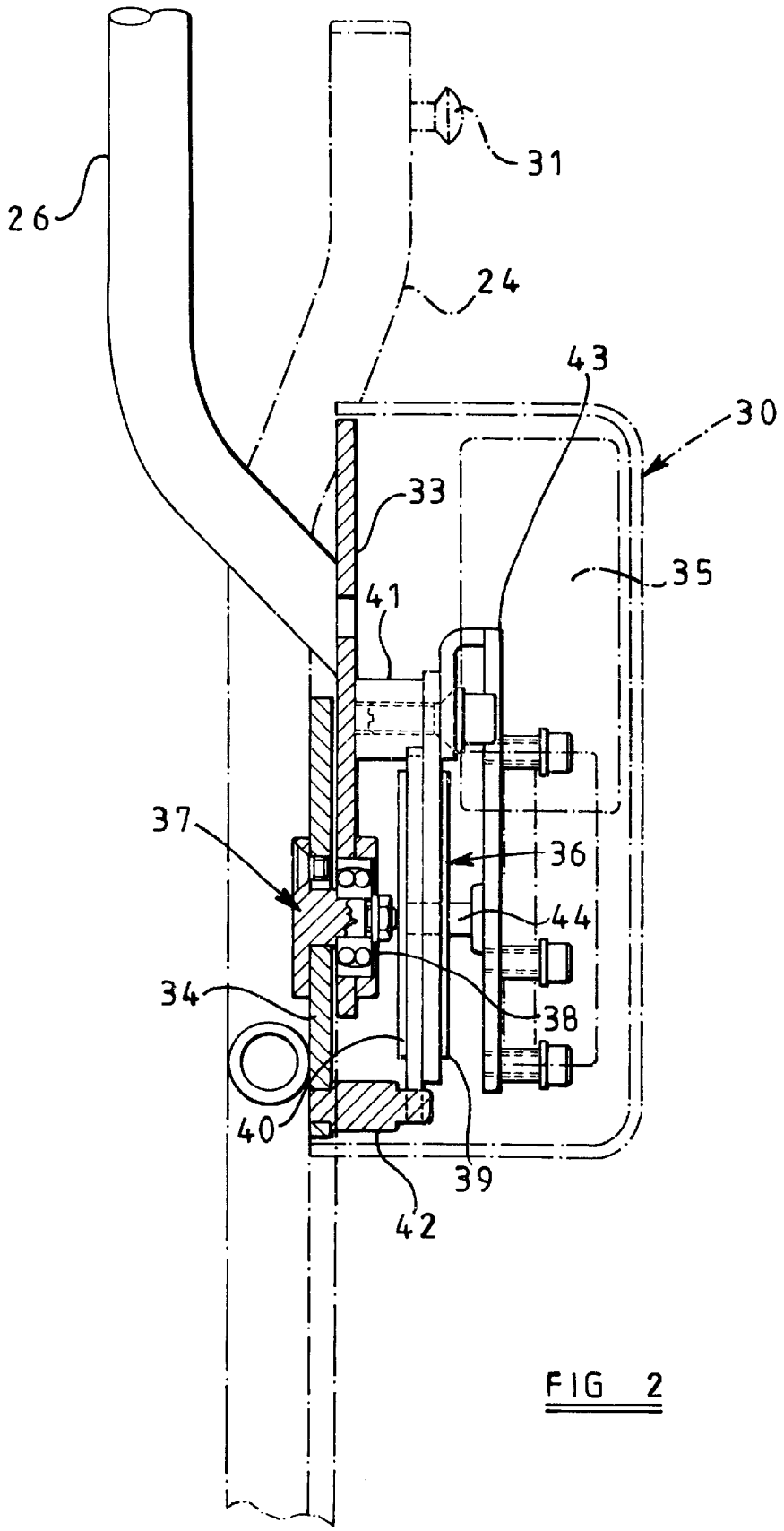
FIG. 2 is a fragmentary sectional view showing the rotary drive mechanism for pivoting the sling hanger relative to the sling hanger support.

Referring now to FIG. 2 of the drawings, the rotary drive mechanism 30 best shown therein comprises a mounting plate 33 secured to the lower end of the limb 26 of the sling hanger support 13 and a pivot plate 34 secured to the limb 24 of the sling hanger 14, an electric motor and gear box unit 35 and a rotary actuator 36. A pivot connection 37 is provided between the mounting plate 33 and the pivot plate 34. The pivot connection 35 includes a roller or ball bearing 38.

The rotary actuator 36 is typically of a type made and sold by SKF under the brand name Victoria. This actuator has a significant step down ratio (typically 55:1) and comprises a stationary part 39 and a rotating part 40. The stationary part is supported on three angularly spaced bushes 41 (only one of which is shown) connected to the mounting plate 33 and the rotating part 40 is keyed to the pivot plate 34 by a peg 42 so that rotation of the rotating part 40 causes the pivot plate 34 and hence the sling hanger 14 to be angularly displaced about the aforesaid horizontal axis extending through the pivotable connection 29 and the pivot connection 30.

The motor and gear box unit 35 is typically a windscreen wiper motor, such as an ITT 403-290, and this unit 35 is supported by a bracket 43 connected to the mounting plate 33 by the bushes 41. The unit 35 has an output shaft 44 which drives the actuator 36.

Figure 3:
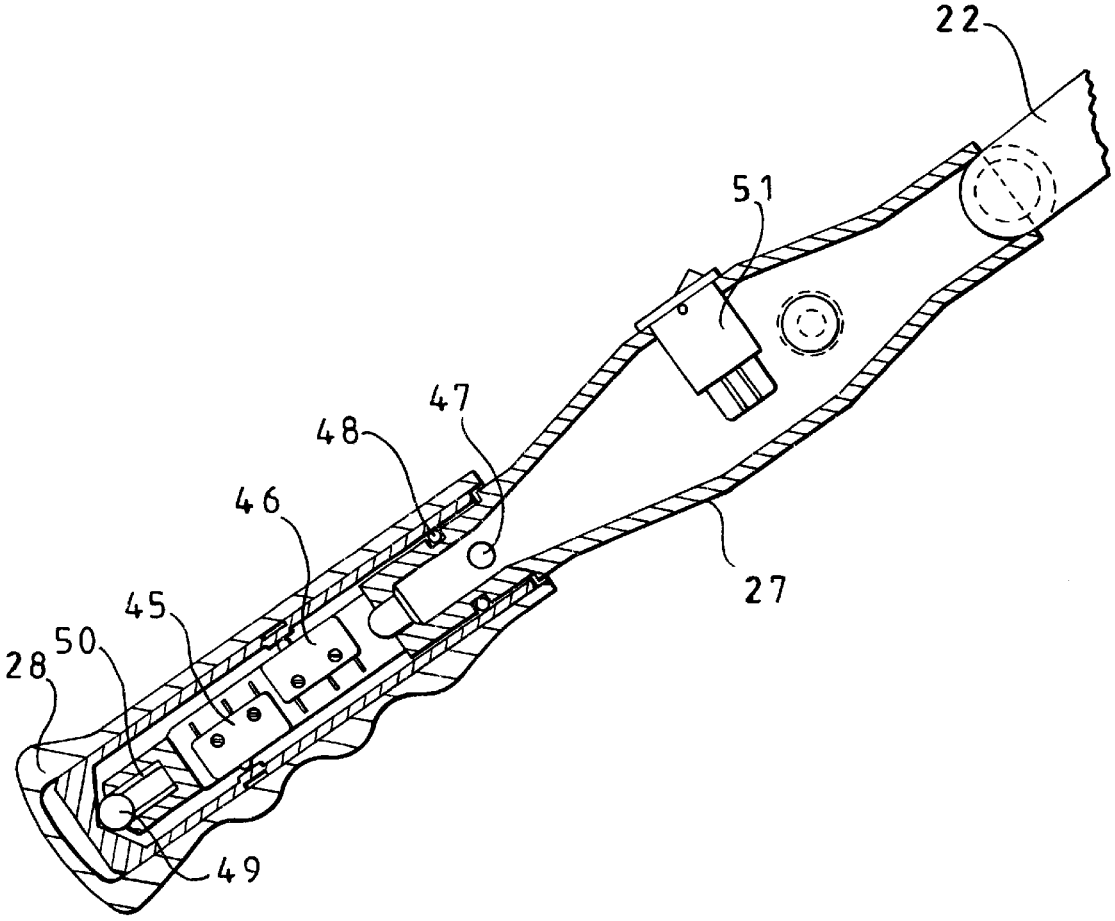
FIG. 3 is a fragmentary sectional view showing the handgrip of the sling hanger.

As shown in FIG. 3, the hand grip 28 is mounted by a pin 47 for limited pivotable movement relative to the arm 27 in a vertical plane and operates one of two microswitches 45,46 according to whether it is moved in an upwards or a downwards direction. An 'O' ring seal 48 is provided between the arm 27 and the hand grip 28 adjacent to the pin 47 and a ball 49 loaded by a spring 50 is provided between the free end of the arm 27 and the inner end of the hand grip 28. The microswitches 45,46 are connected to the motor and gear box unit 35 through the arm 27 and the limb 24 of the sling hanger 14 and the motor and gear box unit 35 is connected to the rechargeable battery 9 by wiring extending through the sling hanger support 13 and the lifting arm 12.

An attendant can pivot the sling hanger 14 by taking hold of the hand grip 28 and applying a gentle upwards or downwards force to the hand grip 28. A downwards force on the hand grip 28 will cause the hand grip to operate the microswitch 46 to rotate the motor and gear box unit 35 in a direction which will pivot the sling hanger 14 so that the arm 27 is lowered. An upwards force on the hand grip 28 will cause the hand grip to operate the other microswitch 45 and the motor and gear box unit 35 will pivot the sling hanger 14 so that the arm 27 is raised.

The rotary drive mechanism 30 thus mimics the known manually displaceable sling hanger but with no strain on the attendant.

An on/off switch 51 can be provided, such as on the arm 27, to de-energise the motor and gear box unit 35 and prevent accidental operation of the rotary drive mechanism 30.

The lifting hoist described above is given by way of example only and various modifications will be apparent to persons skilled in the art without departing from the scope of the invention. For example, the sling hanger support 13 need not be supported by the free outer end of the lifting arm 12 to turn about a rigid vertical axis. It could, instead, be supported so that it can swing relative to the lifting arm.

Also, the lifting arm could be pivotably connected to the lifting column. In this case, the lifting arm could be raised and lowered by pivoting the arm relative to the column such as is described, for example, in GB-A-2184706 or the column could be telescopically extendible/retractable to pivot the lifting arm in a manner such as is described, for example, in EP-A-0805668.

What is claimed is:

1. An invalid hoist comprising a lifting arm, a sling hanger support angularly displaceable relative to the lifting arm about a vertical or substantially vertical axis, a sling hanger which is a unitary construction pivotable about a horizontal axis relative to the sling hanger support and which presents two spaced sling attachment points on one side of the horizontal axis and at least one sling attachment point on the other side of the horizontal axis for connection of a first pair of sling attachments to one side of the horizontal axis and for connection of a second pair of sling attachments to the opposite side of the horizontal axis, rotary drive means for pivoting the sling hanger about said horizontal axis relative to the sling hanger support, and switch means for selectively rotating the rotary drive means in one or other of two opposite directions.

2. A invalid hoist as claimed in claim 1, wherein the rotary drive means comprises an electric motor and gear box unit and a rotary actuator rotatable by the motor and gear box unit.

3. An invalid hoist as claimed in claim 1 , wherein the sling hanger is provided at one end with a hand grip which is pivotable to a limited extent in a vertical or substantially vertical plane relative to the sling hanger, the switch means being operable by pivotable movement of the hand grip in an upwards direction to cause the rotary drive means to pivot the sling hanger so that said one end of the sling hanger is raised relative to the other end and the switch means being operable by pivotable movement of the hand grip in a downwards direction to cause the rotary drive means to pivot the sling hanger so that said one end of the sling hanger is lowered relative to the other end.

4. An invalid hoist as claimed in claim 1, wherein the sling hanger support is of inverted generally U-shaped configuration and the sling hanger comprises a generally U-shaped part, the two limbs of which are pivotally connected to the lower ends of the two limbs of the sling hanger support, respectively, and a central arm extending from the base of the generally U-shaped part away from the pivot axis between the sling hanger and sling hanger support.

5. An invalid hoist as claimed in claim 4, wherein each limb of the U-shaped part has a sling attachment at or adjacent to its free end and at least one sling attachment is provided on the central arm.

6. An invalid hoist as claimed in claim 4, wherein a hand grip is provided at the free end of the central arm.

7. An invalid hoist as claimed in claim 1, further comprising a chassis and a lifting column upstanding from the chassis, the lifting arm projecting from the lifting column.

8. An invalid hoist as claimed in claim 7, wherein means are provided for raising and lowering the lifting arm relative to the lifting column.

9. An invalid hoist as claimed in claim 7, wherein the lifting arm is pivotable relative to the lifting column.

* * * * *